US008878758B2

(12) United States Patent
Cristaudo et al.

(10) Patent No.: US 8,878,758 B2
(45) Date of Patent: Nov. 4, 2014

(54) CHARGE-SHARING PATH CONTROL DEVICE FOR A SCAN DRIVER OF AN LCD PANEL

(75) Inventors: Domenico Cristaudo, Tremestieri Etneo (IT); Stefano Corradi, Siracusa (IT); Stefano Sueri, S. Gregorio di Catania (IT)

(73) Assignee: STMicroelectronics S.r.l., Agrate Brianza (MB) (IT)

( * ) Notice: Subject to any disclaimer, the term of this patent is extended or adjusted under 35 U.S.C. 154(b) by 294 days.

(21) Appl. No.: 13/560,298

(22) Filed: Jul. 27, 2012

(65) Prior Publication Data

US 2013/0027283 A1 Jan. 31, 2013

(30) Foreign Application Priority Data

Jul. 29, 2011 (IT) ..... MI2011A1441

(51) Int. Cl.
*G09G 3/36* (2006.01)
*G09G 5/00* (2006.01)

(52) U.S. Cl.
CPC ..... *G09G 3/3674* (2013.01); *G09G 2330/023* (2013.01)
USPC ..... 345/87; 345/90; 345/92; 345/98; 345/211

(58) Field of Classification Search
USPC ..... 345/87–100, 204, 211
See application file for complete search history.

(56) References Cited

U.S. PATENT DOCUMENTS

| | | | | |
|---|---|---|---|---|
| 6,549,186 | B1 * | 4/2003 | Kwon | 345/95 |
| 7,330,066 | B2 * | 2/2008 | Huang | 327/540 |
| 7,463,054 | B1 * | 12/2008 | Parris et al. | 326/31 |
| 8,031,146 | B2 * | 10/2011 | Park et al. | 345/87 |
| 8,624,818 | B2 * | 1/2014 | Brokaw et al. | 345/99 |
| 8,749,536 | B2 * | 6/2014 | Shiu et al. | 345/204 |
| 2002/0149965 | A1 * | 10/2002 | Campardo et al. | 365/185.03 |
| 2004/0246215 | A1 * | 12/2004 | Yoo | 345/87 |
| 2007/0285355 | A1 | 12/2007 | Bourgoin et al. | |
| 2009/0015297 | A1 * | 1/2009 | Chen et al. | 327/108 |
| 2009/0225018 | A1 | 9/2009 | Kim | |
| 2009/0256832 | A1 | 10/2009 | Ding | |
| 2010/0109995 | A1 * | 5/2010 | Fang | 345/100 |
| 2010/0134172 | A1 * | 6/2010 | Hsu et al. | 327/296 |
| 2010/0315322 | A1 | 12/2010 | Cheng et al. | |

* cited by examiner

*Primary Examiner* — Amare Mengistu
*Assistant Examiner* — Benyam Ketema
(74) *Attorney, Agent, or Firm* — Allen, Dyer, Doppelt, Milbrath & Gilchrist, P.A.

(57) ABSTRACT

A bidirectional switch includes a pair of transistors, with each transistor including a source connected via a degeneration resistance to a common source control node, a gate connected to a common gate control node, a drain connected to a respective channel or gate line and to a charge storage node, respectively, and a clamp diode connected between the source and the gate. This forms a single charge transfer path between gate lines sequentially activated by a scan driver of an LCD panel, and implements a charge sharing technique for reducing power dissipation.

16 Claims, 4 Drawing Sheets

CHARGE-SHARING PATH CONTROL DEVICE FOR A SCAN DRIVER OF AN LCD PANEL

FIELD OF THE INVENTION

The present invention relates in general to LCD panels with reduced power dissipation, and in particular, to a bidirectional single path charge sharing switching device in a scan driver configured to scan numerous channels (gate lines) in sequence with reduced power dissipation.

BACKGROUND OF THE INVENTION

In current display panels, the scanning frequency is ever increasing to support high definition image frame rates, especially for 3D image visualization, where the frame rate is double compared to the equivalent 2D visualization. With this trend, power dissipation, which is also tied to the size of the displays, is a serious concern. As a result, scan driver design is becoming more and more challenging.

Charge sharing techniques have been developed, and are being implemented by major panel manufacturers. The charge sharing method reuses (recycles) part of the electrical charge accumulated in the activated, commonly buffered, channel or gate line being turned off to assist in charging the next channel or gate line to be activated. If properly implemented, the charge sharing may procure a significant energy saving.

U.S. Pat. No. 7,750,715 discloses a method for generating a first clock signal in a first signal path in response to a first input signal, and a second clock signal in a second signal path in response to a second input signal. The first and second lock signals assume first and second clock levels to transfer electrical charges from an ancillary charge storage component to one and to the other output, respectively, to reduce power dissipation when performing a multichannel scanning, as in an LCD display.

Implementation of a charge sharing function to reduce power dissipation is also disclosed in data sheets of commercial devices TPS 65191 and TPS 65193, as provided by Texas Instruments. The charge sharing function is limited to a sharing between complementary outputs, and availability of relatively high voltage zener diodes in the silicon fabrication technology is required.

U.S. Published Patent Application No. 2010/0109995 discloses a gate driving device used in an LCD display. The gate driving device includes a plurality of gate lines, with each gate line including a plurality of output stages, a couple of complementary switches and a control module. The gate driving device implements a charge sharing function to reduce power consumption. The approach is not applicable to GOA panels because of the relatively high voltage rails required with this LCD technology for correct driving of the gate lines. Even a hypothetical implementation of the disclosed circuits with high voltage MOSFETs would not work because of the presence of an intrinsic diode between the source and drain that could provide an undesirable discharge path to the channels during a charge sharing phase. Charge sharing is implemented only between adjacent channels.

Ideally, implementations of a charge sharing function in a scan driver device for a multichannel LCD panel should be possible even if the fabrication process technology does not contemplate the possibility of integrating relatively high voltage diodes, and yet support high voltage operated LCD panels (GOA panels). Moreover, for enhanced flexibility of use, it should be possible to share part of the channel activation charge among any couple of channels to be sequentially activated, not necessarily adjacent, and to support the use of an external capacitor as an ancillary charge storage element.

SUMMARY OF THE INVENTION

All the above remarked desirable features and capabilities of charge sharing implementing circuits in a scan driver for multichannel LCD panels are achieved with a single path bidirectional switch instead of implementing two distinct charge paths as in prior art devices.

Basically, a bidirectional switch may comprise a pair of transistors having the same characteristics, with each transistor including a source connected via a degeneration resistance to a common source control node, a gate connected to a common gate control node, a drain connected to a respective channel or gate line and to a charge storage node, respectively, and a clamp diode connected between the source and the gate. This forms the single charge transfer path.

A charge transfer control circuit may comprise first and second latches, each controlled by a control logic circuit receiving input signals from the timing control circuit of the scan driver. The latches may have an output node connected to the common gate control node and to the common source control node, respectively, of the bidirectional switch for tying both control nodes to the lowest voltage rail for disabling the charge-sharing path during off periods and for pulling up both control nodes during a turn-off or a turn-on phase of the channel or gate line coupled to the drain of at least one of the transistors forming the bidirectional switch.

With the bidirectional switch forming a single controlled charge transfer path, a charge may be efficiently and safely transferred in either direction. For example, a charge may be transferred from a charged channel or gate line being turned off after having been activated by the scan driver, to a charge storage node that may be an adjacent channel coupled to the other end of the bidirectional two-transistor switch or any other sort of charge storing capacitance, and vice-versa, from the charge storage node to any other channel or gate line being turned on by the scan driver.

In either direction, the charge transfer current may flow through one of the transistors and through the source-drain parasitic diode of the other transistor. Clamp diodes, connected between the gate and source of each transistor, may protect the gate-oxide by limiting the overvoltage peak during the turn-on transient.

The source degenerating resistance may limit the current peak in the charge sharing path to avoid turning on parasitic PNP transistors that could form between the source region and the silicon substrate, as known to one skilled in the art, thus preserving efficiency of the charge recycling process. The rate of charge transfer may be set by choosing the degeneration resistance value.

The latched structure of the charge transfer control circuit may have an additional advantage of sensibly reducing the biasing current necessary for ensuring an appropriate duration of the charge transfer phase for a full charge sharing, compared to a non-latched switching structure.

The invention is clearly defined in the annexed claims, the content of which is intended to be part of this description.

DETAILED DESCRIPTION OF THE PREFERRED EMBODIMENT

Figure 1:
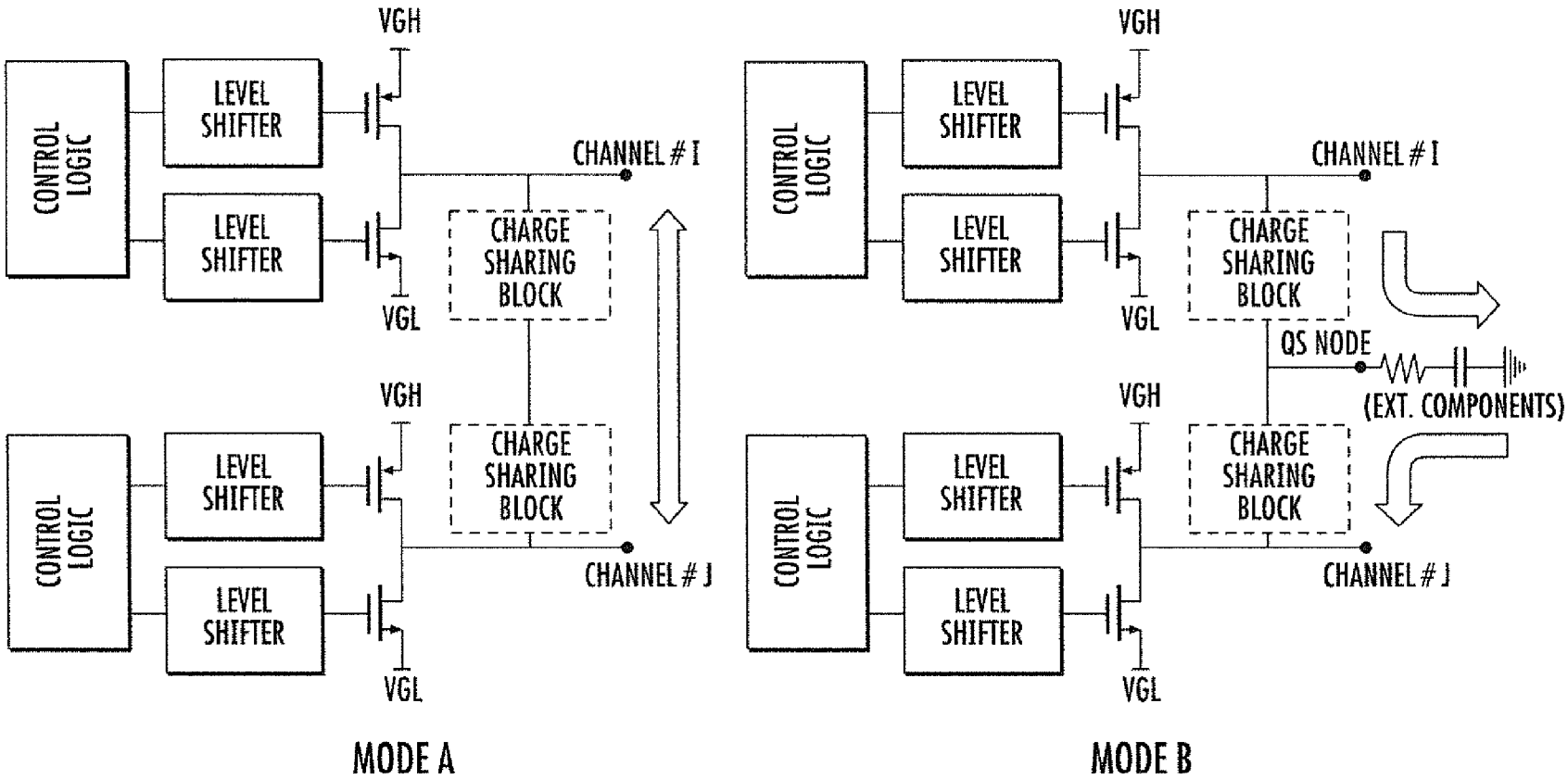
FIG. 1 illustrates two alternative modes of implementing a charge sharing function among distinct scan channels, sequentially activated by a scan driver of an LCD panel according to an embodiment of the present invention.

The basic functional block diagrams of FIG. 1 represent the same level-shifter-output-buffer block diagram of a scan driver for an LCD panel, including functional circuitry, depicted by the shaded blocks, for implementing a charge sharing function according to two different operating modes.

According to a Mode A implementation, charge sharing occurs between adjacent scan channels sequentially activated by the scan driver. According to the Mode B implementation, charge sharing occurs through a charge storage node QS. This is other than a total capacitance associated with an adjacent channel, which is typically an externally connected capacitor. The bidirectional single path charge sharing device supports both modes of implementation of the charge sharing function.

Figure 2:
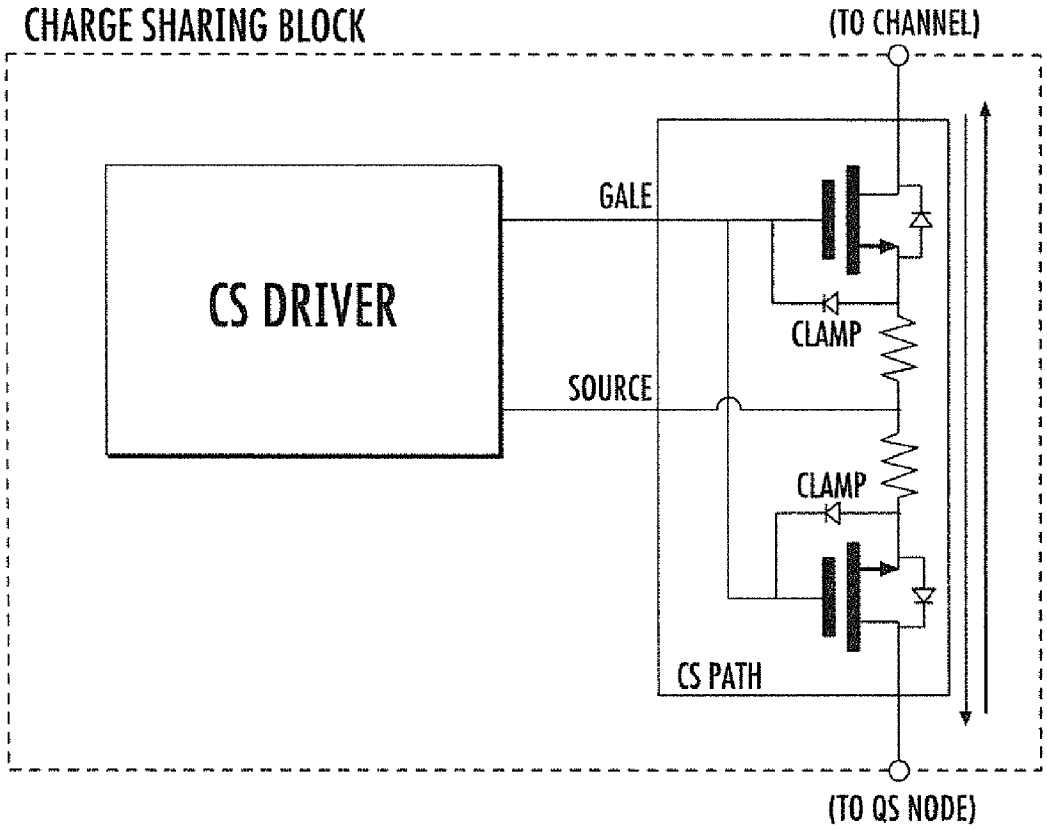
FIG. 2 is a basic illustration of a single bidirectional charge sharing path according to an embodiment of the present invention.

FIG. 2 is a basic illustration of an exemplary embodiment of a bidirectional switch used in the bidirectional single path charge sharing device as discussed herein. According to this embodiment, the bidirectional switch, forming a bidirectional single charge transfer path, includes a pair of NMOS transistors having identical characteristics. Each transistor includes a source connected via a degeneration resistance to a common source control node, a gate connected to a common gate control node, a drain connected to a respective channel or to a charge storage node QS, respectively, and a clamp diode connected between the source and the gate.

The clamp diode connected between the gate and the source of each transistor protects the NMOS gate-oxide by limiting the voltage peak during turn-on transients. The source resistances limit the peak current flowing in the bidirectional charge transfer path to avoid the possible turn-on of parasitic PNP transistors that may form between the source region and the substrate of the integrated structure of the NMOS transistors, thus safeguarding the efficiency of the charge recycling process.

Figure 3:
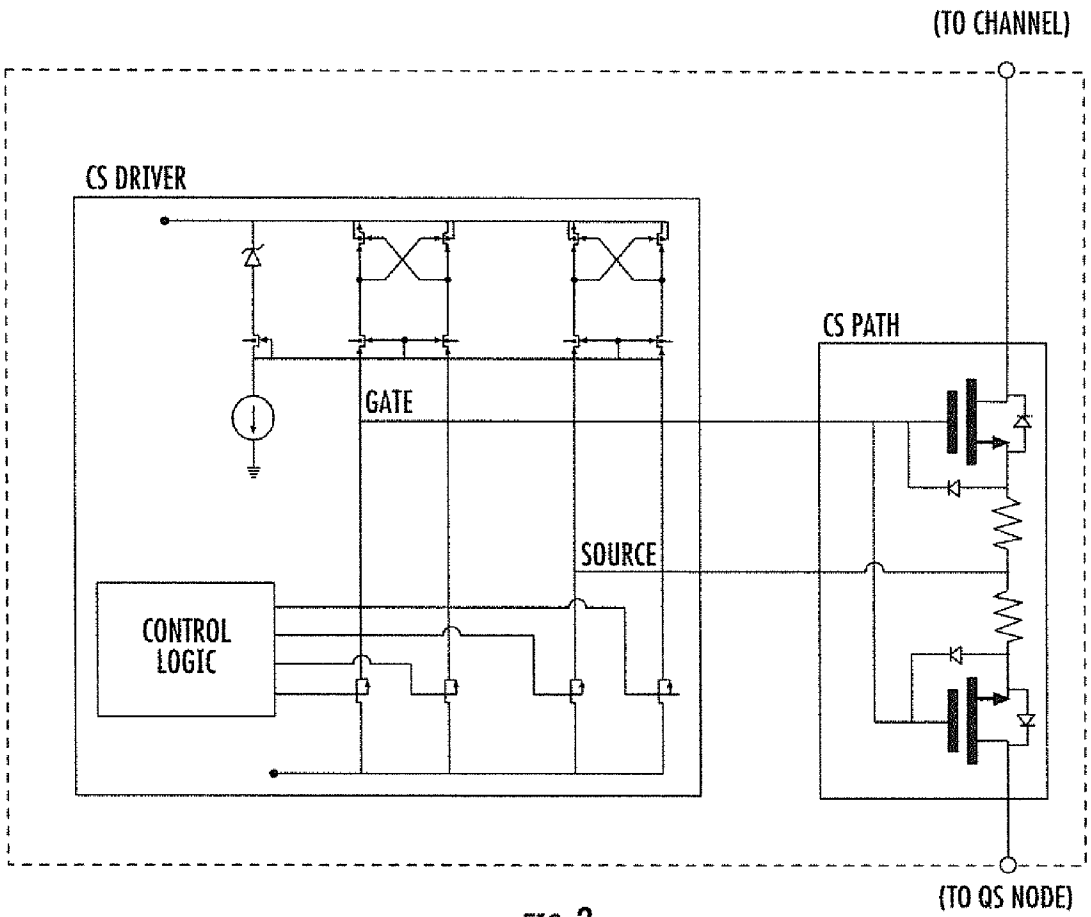
FIG. 3 is a basic circuit diagram of the bidirectional switch and of the related controlled driving circuit according to an embodiment of the present invention.

FIG. 3 shows the circuit diagram of the bidirectional switch and of the controlled driving circuit of the two-transistor switch. The controlled driving circuit depicted in the contoured box comprises first and second latches. Each latch is controlled by a control logic circuit receiving input signals from the timing control circuit of the scan driver.

The latches have an output node connected to the common gate control node and to the common source control node, respectively, of the bidirectional switch. This is for tying both control nodes to the lowest voltage rail for disabling the charge-sharing path during off periods and for pulling up both control nodes during a turn-off or a turn-on phase of the channel or gate line coupled to the drain of at least one of the transistors forming the bidirectional switch.

Reference numbers have not been introduced in the drawings so as not to interfere with the observation of the depicted circuits and components, the symbolic representation of which makes them immediately recognizable by one skilled in the art.

Figure 4:
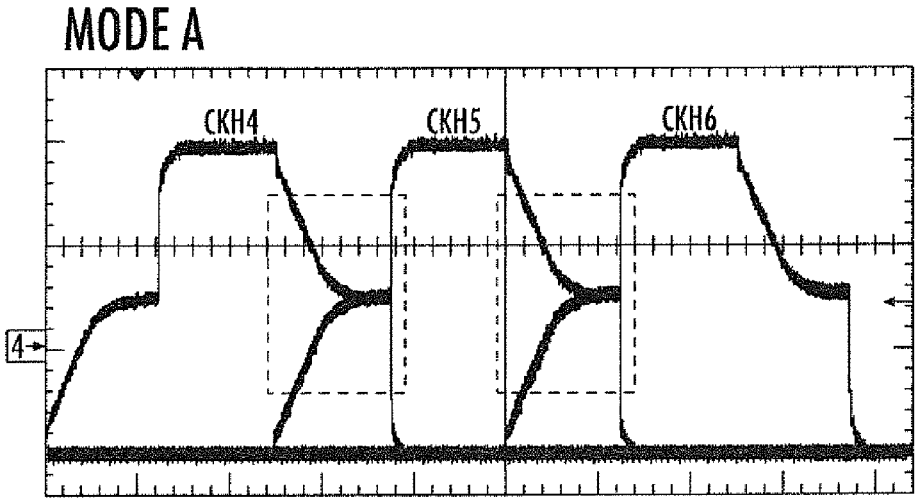
FIG. 4 shows the waveforms of a charge sharing function implemented with the bidirectional single path charge sharing switch according to mode A of FIG. 1.

FIG. 4 shows the waveforms during a turning off phase of one channel and a turning on phase of the other of a charge sharing function implemented with the bidirectional single path charge sharing switch according to mode A of FIG. 1. Adjacent channels CKH4 and CKH5, and successively CKH5 and CKH6 in the plot, directly share the charge during a turning off phase of one and turning on phase of the other, without using any ancillary charge storage component. The recycling of part of the electrical charge of activation of a scan channel to assist in charging the next channel to be activated by the scan driver takes place in just a single phase.

Figure 5:
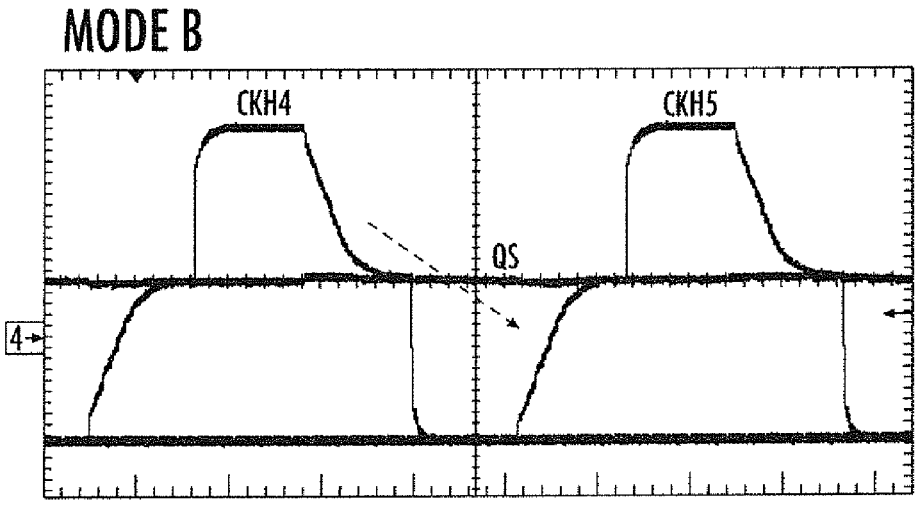
FIG. 5 shows the waveforms of a charge sharing function implemented with the bidirectional single path charge sharing switch according to mode B of FIG. 1.

FIG. 5 shows the waveforms of a charge sharing function implemented with the bidirectional single path charge sharing switch according to mode B of FIG. 1. Any pair of channels in this mode, CKH4 and CKH5 in the plot, but which may not even be consecutive, share the charge during a charge sharing time frame in two steps (two phases) that include a turning off phase of one and a turning on phase of the other, via an ancillary charge storing capacitance. This may typically be an externally connected capacitor, according to the charge sharing circuit depicted in the scheme of FIG. 1 relative to the mode B alternative.

That which is claimed:

1. A charge-sharing path control device for a scan driver for use in an LCD panel with a plurality of sequentially activated channels, comprising:

a bidirectional switch defining a single charge transfer path and comprising a pair of transistors, with each transistor comprising a degeneration resistance, a common source control node, a source connected, via said degeneration resistance, to said common source control node, a common gate control node, a gate connected to said common gate control node, a drain to be coupled to a respective one of the activated channels and to be coupled to a charge storage node, respectively, and a clamp diode connected between said source and said gate; and a charge transfer having an output connected to said common gate control node and to said common source control node, respectively, of said bidirectional switch for tying both control nodes to a low voltage supply for disabling the charge-sharing path during off periods and for pulling up both control nodes during a turn-off or a turn-on phase of the activated channel.

2. The charge-sharing path control device of claim 1, wherein said charge transfer control circuit comprises first and second latches, and a control logic circuit coupled thereto, with each latch being controlled by said control logic circuit and having an output connected to said common gate control node and to said common source control node, respectively, of said bidirectional switch.

3. The charge-sharing path control device of claim 1, wherein said charge storage node comprises a channel adjacent to the one connected to said drain of the other transistor of said bidirectional switch.

4. The charge-sharing path control device of claim 1, wherein the charge storage node comprises a pad to be connected to an external capacitor.

5. The charge-sharing path control device of claim 1, wherein each transistor comprises an N-type MOSFET.

6. A scan driver for an LCD panel comprising:

a plurality of output buffers configured to output a plurality of gate signals to a plurality of respective gate lines to be sequentially activated, with each output buffer comprising a charge-sharing path control device comprising a bidirectional switch defining a single charge transfer path and comprising a pair of transistors, with each transistor comprising a degeneration resistance, a common source control node, a source connected, via said degeneration resistance, to said common source control node, a common gate control node, a gate connected to said common gate control node, a charge storage node, a drain coupled to a respective one of the activated channels and coupled to said charge storage node, respectively, a clamp diode connected between said source and said gate; and with each bidirectional switch in said charge-sharing path control device being coupled between adjacent gate lines adapted to transfer charge from a line being turned off to the other line being turned on; and a charge transfer having an output connected to said common gate control node and to said common source control node, respectively, of said bidirectional switch for tying both control nodes to a low voltage supply for disabling the charge-sharing path during off periods and for pulling up both control nodes during a turn-off or a turn-on phase of the activated channel.

7. The scan driver of claim 6, wherein said charge transfer control circuit comprises first and second latches, and a control logic circuit coupled thereto, with each latch being controlled by said control logic circuit and having an output connected to said common gate control node and to said common source control node, respectively, of said bidirectional switch.

8. The scan driver of claim 6, wherein each transistor comprises an N-type MOSFET.

9. A scan driver for an LCD panel comprising:

a plurality of output buffers configured to output a plurality of gate signals to a plurality of respective gate lines to be sequentially activated, with each output buffer comprising a charge-sharing path comprising a bidirectional switch defining a single charge transfer path and comprising a pair of transistors, with each transistor comprising a degeneration resistance, a common source control node, a source connected, via said degeneration resistance, to said common source control node, a common gate control node, a gate connected to said common gate control node, a charge storage node, a drain coupled to a respective one of the activated channels and to said charge storage node, respectively, a clamp diode connected between said source and said gate; and with said charge storage node comprising a pad to be connected to an external capacitor; and a charge transfer having an output connected to said common gate control node and to said common source control node, respectively, of said bidirectional switch for tying both control nodes to a low voltage supply for disabling the charge-sharing path during off periods and for pulling up both control nodes during a turn-off or a turn-on phase of the activated channel.

10. The scan driver of claim 9, wherein said charge transfer control circuit comprises first and second latches, and a control logic circuit coupled thereto, with each latch being controlled by said control logic circuit and having an output connected to said common gate control node and to said common source control node, respectively, of said bidirectional switch.

11. The scan driver of claim 9, wherein each transistor comprises an N-type MOSFET.

12. A method for making a charge-sharing path control device for a scan driver for use in an LCD panel with a plurality of sequentially activated channels, the method comprising:

providing a bidirectional switch to define a single charge transfer path, with the bidirectional switch comprising a pair of transistors, and with each transistor comprising a degeneration resistance, a common source control node, a source connected, via the degeneration resistance, to the common source control node, a common gate control node, a gate connected to the common gate control node, a drain to be coupled to a respective one of the activated channels and to be coupled to a charge storage node, respectively, and a clamp diode connected between the source and the gate; and providing a charge transfer having an output connected to the common gate control node and to the common source control node, respectively, of the bidirectional switch for tying both control nodes to a low voltage supply for disabling the charge-sharing path during off periods and for pulling up both control nodes during a turn-off or a turn-on phase of the activated channel.

13. The method of claim 12, wherein the charge transfer control circuit comprises first and second latches, and a control logic circuit coupled thereto, with each latch being controlled by the control logic circuit and having an output connected to the common gate control node and to the common source control node, respectively, of the bidirectional switch.

14. The method of claim 12, wherein the charge storage node comprises a channel adjacent to the one connected to the drain of the other transistor of the bidirectional switch.

15. The method of claim 12, wherein the charge storage node comprises a pad to be connected to an external capacitor.

16. The method of claim 12, wherein each transistor comprises an N-type MOSFET.

* * * * *